US008477968B2

(12) United States Patent
Chang

(10) Patent No.: US 8,477,968 B2
(45) Date of Patent: Jul. 2, 2013

(54) THERMAL ACOUSTIC SPEAKER

(75) Inventor: Jen-Tsorng Chang, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 302 days.

(21) Appl. No.: 12/910,841

(22) Filed: Oct. 24, 2010

(65) Prior Publication Data

US 2011/0293118 A1 Dec. 1, 2011

(30) Foreign Application Priority Data

May 28, 2010 (CN) ..... 2010 1 0185385

(51) Int. Cl.
*H04R 25/00* (2006.01)

(52) U.S. Cl.
USPC ..... 381/164; 381/150

(58) Field of Classification Search
USPC ..... 381/164, 386, 150, 345, 387
See application file for complete search history.

(56) References Cited

U.S. PATENT DOCUMENTS 8,259,966 B2 * 9/2012 Jiang et al. ..... 381/164
2010/0166232 A1 * 7/2010 Liu et al. ..... 381/164

OTHER PUBLICATIONS

Lin Xiao, Zhuo Chen, Chen Feng, Liang Liu et al.; Flexible, Stretchable, Transparent Carbon Nanotube Thin Film Loudspeakers; 2008; Nano Letters; vol. 8, No. 12; pp. 4539-4545.*
What Are The Physical Properties of Carbon Nanotubes?; Oct. 2009; Nanogloss.com; Retrieved from the Internet: http://nanogloss.com/nanotubes/what-are-the-physical-properties-of-carbon-nanotubes/.*
Lin Xiao, Zhuo Chen, Chen Feng, Liang Lu et al.; Flexible, Stretchable, Transparent Carbon Nanotube Thin Film Loudspeakers; 2008; Nano Letters; vol. 8, No. 12; pp. 4539-4545.*
What Are the Physical Properties of Carbon Nanotubes?; Oct. 2009; nanogloss.com; retrieved from the internet: http://nanogloss.com/what-are-the-physical-properties-of-carbon-nanotubes/.*

* cited by examiner

*Primary Examiner* — Brian Ensey
*Assistant Examiner* — Sabrina Diaz
(74) *Attorney, Agent, or Firm* — Altis Law Group, Inc.

(57) ABSTRACT

A thermal acoustic speaker comprises a body and a thermoelectric converter. The body comprises a shell with at least one hole and a side with a sound hole. The shell defines a sound cavity in the body. The thermoelectric converter, disposed around at least a part of the shell, comprises a circuit and a conductive membrane and covers at least a part of the at least one hole. The circuit receives at least one electrical audio signal. The conductive membrane contacts a part of the circuit so that the thermoelectric converter heats air in the sound cavity to emit sound.

11 Claims, 5 Drawing Sheets

THERMAL ACOUSTIC SPEAKER

BACKGROUND

1. Technical Field

The present disclosure relates to a speaker, and more particularly, relates to a speaker for emitting sound according to the thermal acoustic effect.

2. Description of Related Art

A common type of speaker is a moving-coil speaker. Moving-coil loudspeakers employ a magnetic "motor" to produce movement of a diaphragm which, in turn, produces sound. A cone is typically disposed within a frame of the diaphragm, with the wide end of the cone coupled to the frame by way of flexible membrane, called a suspension or surround, which axially centers the cone within the frame, yet allows back and forth motion at audio frequencies. The narrow end of the cone is coupled to the frame by another flexible membrane, called a spider, which also helps to axially center the moving diaphragm.

The motor is made up of a voice coil, disposed behind the narrow end of the cone, and a magnetic circuit, disposed adjacent to and/or partially surrounding the voice coil. In operation, electrical audio signals from an amplifier (or other source) are applied to the voice coil, producing a varying electromagnetic field. This interacts with the magnetic field of the magnet circuit, causing the voice coil to move. Because the voice coil is coupled to the diaphragm, its movement causes the diaphragm to expand and contract, pressurizing and depressurizing surrounding air and, producing sound waves.

Moving-coil loudspeakers, however, consume considerable power can be too large for many practical applications. Although the art has made strides toward minimizing these shortcomings, there remains a need for a compact and low power consumption speaker that can be easily installed and efficiently operated.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Embodiments of a speaker are now described in detail with reference to the accompanying drawings.

Figure 1:
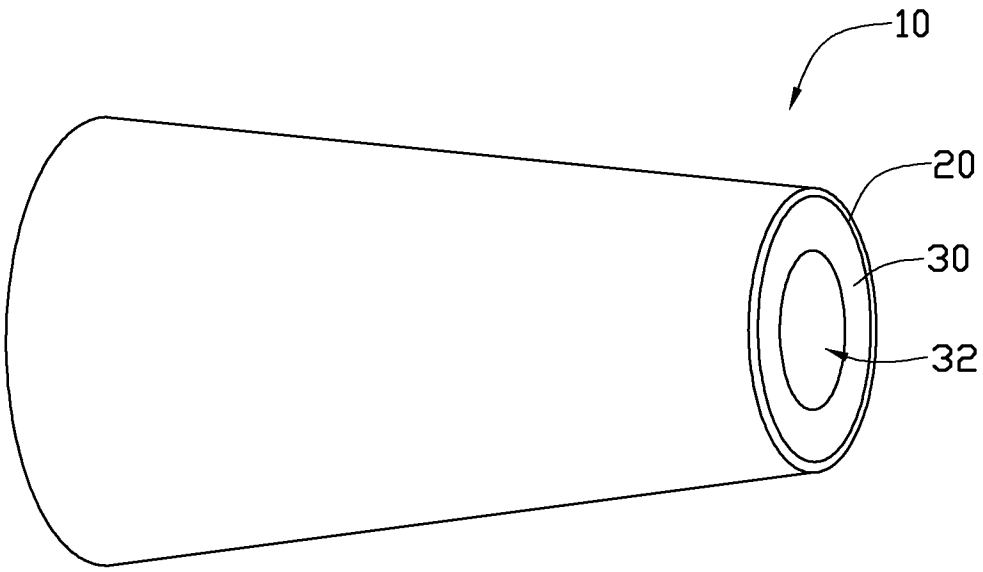
FIG. 1 is a schematic view of a speaker according to a first embodiment of the present disclosure.
Figure 2:
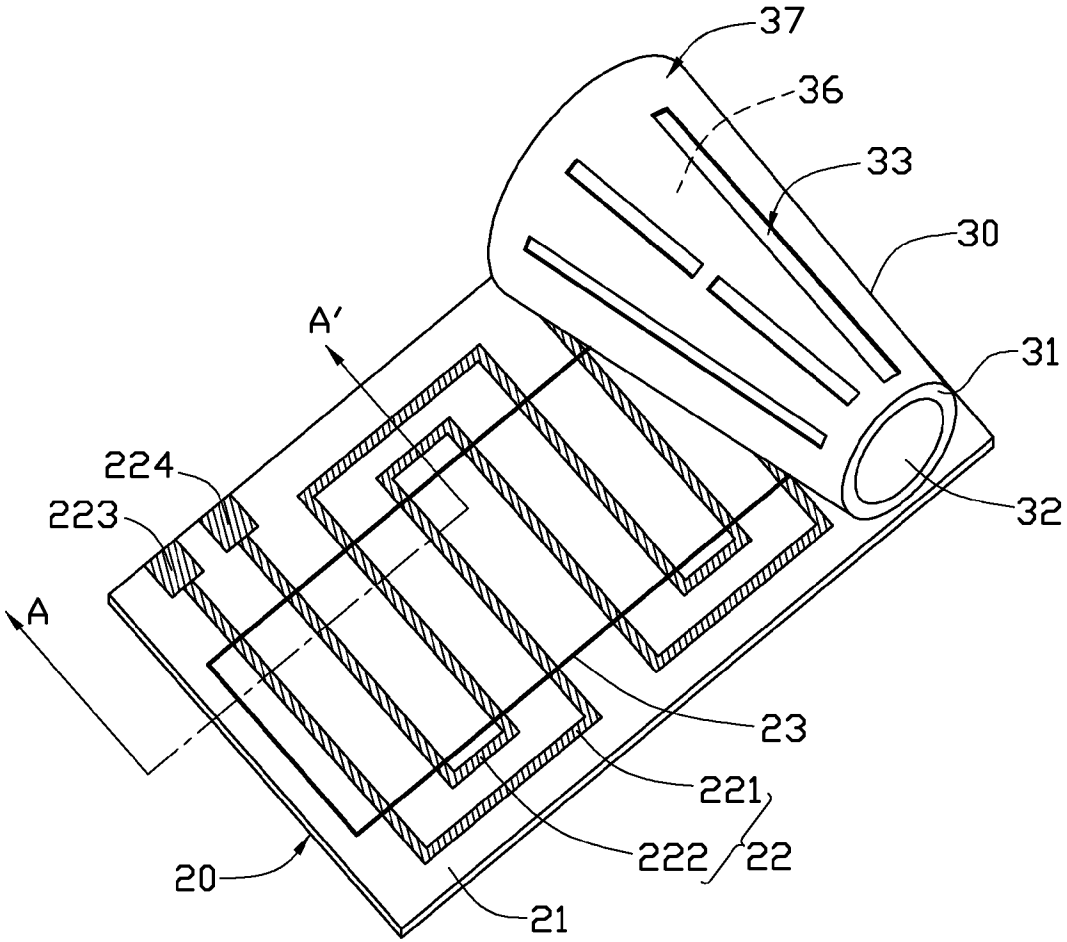
FIG. 2 is another schematic view of the speaker shown in FIG. 1.

According to a first embodiment, a speaker 10 as illustrated in FIG. 1 and FIG. 2 comprises a body 30 and a thermoelectric converter 20.

The body 30 comprises a shell 37 with at least one hole 33 and a first side 31 with a first sound hole 32. The shell 37 defines a sound cavity 36 in the body 30. The hole 33 of the shell 37 and the first sound hole 32 of the first side 31 are connected to the sound cavity 36 in the body 30 individually. In other words, the hole 33 of the shell 37 and the first sound hole 32 of the first side 31 are connected to each other via the sound cavity 36. In the first embodiment, the body 30 is a truncated cone, as shown in FIG. 1; however, in other embodiments, the body 30 can be an elliptic cylinder, a triangular prism, a cuboid, a polygonal prism or an irregular prism for different requirements. Accordingly, the first sound hole 32 can be a circle, an ellipse, a triangle, a rectangle, an irregular shape or a polygon corresponding to the different forms of the body 30. The shell 37 is fabricated by an insulating material or metal, and can be heated, for example to approximately 300° C. More specifically, when the shell 37 is metal, the surface of the metal can be covered by an insulating film, or processed by a passive process so that the shell 37 is insulated.

The thermoelectric converter 20 is disposed around at least a part of the shell 37 and comprises a flexible membrane 21, a circuit 22 and a conductive membrane 23. In the first embodiment, the thermoelectric converter 20 adheres around the shell 37 by an adhesive; however, in other embodiments, the body thermoelectric converter 20 can adhere around the shell 37 by other manners for different requirements. Accordingly, the thermoelectric converter 20 covers at least a part of the hole 33 of the shell 37.

The circuit 22 and the conductive membrane 23 are disposed on the flexible membrane 21, and the conductive membrane 23 contacts a part of the circuit 22. More specifically, the circuit 22 comprises a first conducting wire 221 and a second conducting wire 222 which is substantially parallel with the first conducting wire 221. In the first embodiment, the first conducting wire 221 and the second conducting wire 222 are individually disposed on the flexible membrane 21 as right angle; however, in other embodiments, the first conducting wire 221 and the second conducting wire 222 can be individually disposed on the flexible membrane 21 as an oblique angle for different requirements.

Furthermore, the circuit 22 comprises a first electrode 223, electrically connected to one end of the first conducting wire 221, and a second electrode 224, electrically connected to one end of the second conducting wire 222. In addition, two ends of the first conducting wire 221 are connected to each other to form a loop, and two ends of the second conducting wire 222 are connected to each other to form another loop. For simplification, the loops of the first and second conducting wires 221, 222 are not shown in FIG. 2.

The circuit 22 and the conductive membrane 23 are electrically connected to each other due to the conductive membrane 23 contacting a part of the circuit 22. In operation, electrical audio signals (not shown) from an amplifier (or other source) are respectively input to the thermoelectric converter 20 of the speaker 10 via the first electrode 223 and the second electrode 224; however, in other embodiments, the electrical audio signals can be respectively input to the thermoelectric converter 20 of the speaker 10 via one end of the first conducting wire 221 and one end of the second conducting wire 221. In addition, the first conducting wire 221 can appear as a plurality of first conducting wires and the second conducting wire 222 a plurality of second conducting wires such that the electrical audio signals can be input to the thermoelectric converter 20 of the speaker 10 via these first conducting wires and second conducting wires.

In some examples, the conductive membrane 23 can be an anisotropic conductive film (ACF), for example a carbon nanotube array comprising a plurality of carbon nanotubes (CNTs) in the first embodiment. Thus, the conductive membrane 23 will conduct the electrical audio signals between the first and second conducting wires 221, 222 due to a conductive direction of the anisotropic conductive film is substantially perpendicular to extended directions of the first and second conducting wires 221, 222. Accordingly, the thermoelectric converter 20 generates heat according to conduction of the electrical audio signals from the first and second conducting wires 221, 222. After the heat is generated from the thermoelectric converter 20, air of the sound cavity 36 is heated to resonate through the hole 33 to emit sounds via the first sound hole 32 of the first side 31.

Figure 3:
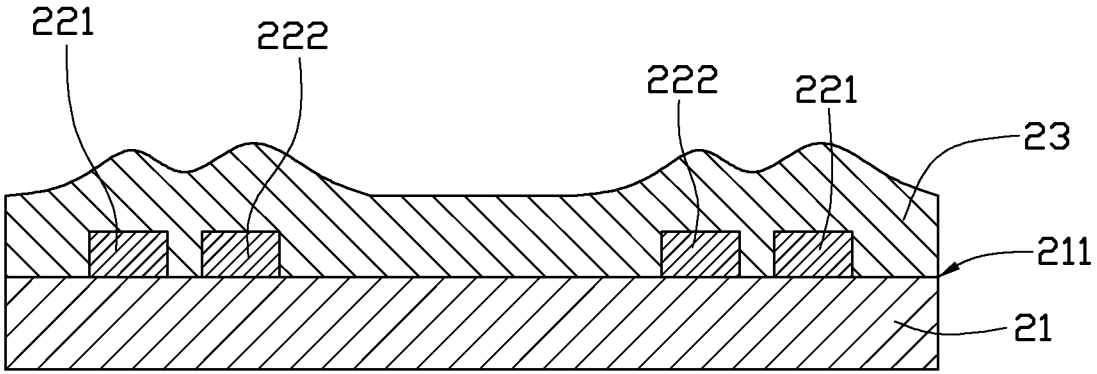
FIG. 3 is a cross-section of a thermoelectric converter of the speaker shown in FIG. 2 taken along line A-A'.
Figure 4:
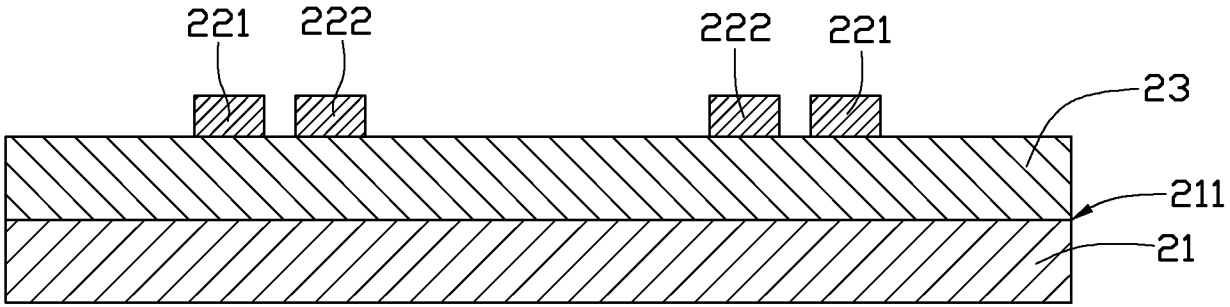
FIG. 4 is another cross-section of the thermoelectric converter of the speaker shown in FIG. 2, taken along line A-A' in FIG. 2.

FIG. 3 and FIG. 4 are cross-sections of a thermoelectric converter of the speaker shown in FIG. 2, individually, and the cross-section is taken along line A-A' in FIG. 2. As shown in FIG. 3, the circuit 22 comprising the first conducting wire 221 and the second conducting wire 222 is disposed on a surface 211 of the flexible membrane 21, and the conductive membrane 23 is covered on the circuit 22. In other words, the circuit 22 is disposed between the surface 211 of the flexible membrane 21 and the conductive membrane 23.

Alternatively, as shown in FIG. 4, the conductive membrane 23 is disposed on the surface 211 of the flexible membrane 21, and the circuit 22 comprising the first conducting wire 221 and the second conducting wire 222 is disposed on the conductive membrane 23.

Figure 5:
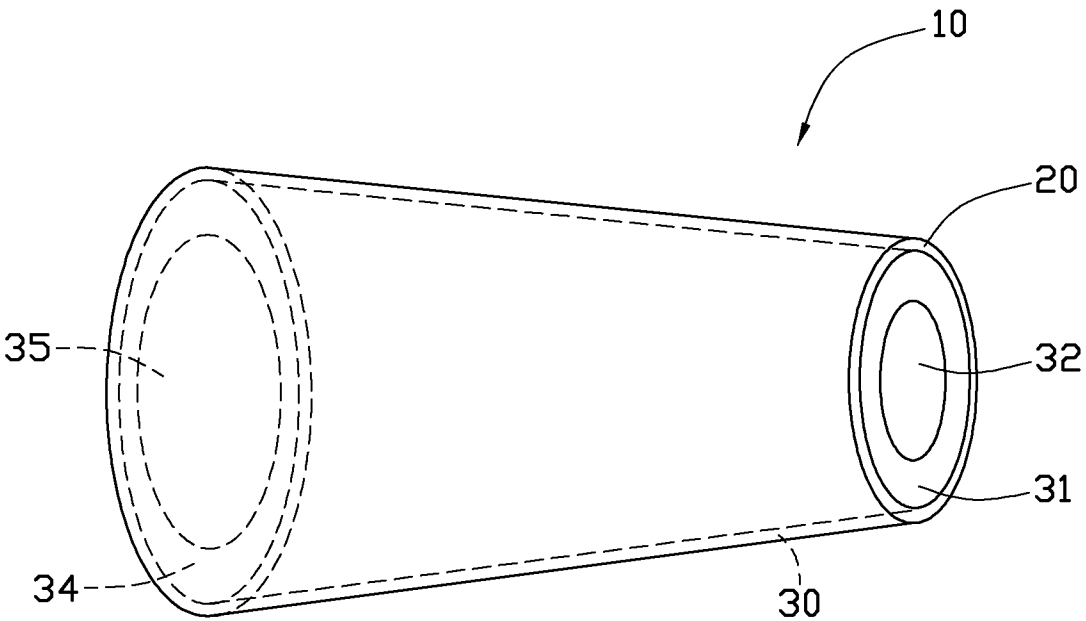
FIG. 5 is a perspective view of a speaker according to a second embodiment of the present disclosure.

In a second embodiment of the present disclosure, speaker 10 is shown in FIG. 5. Speaker 10 shown in FIG. 5 further comprises a second side 34 with a second sound hole 35. The second sound hole 35 of the second side 34 is connected to the sound cavity 36 in the body 30. In other words, the hole 33 of the shell 37 and the second sound hole 35 of the second side 34 are connected to each other via the sound cavity 36. Similarly, air in the sound cavity 36 is heated to resonate via the hole 33 to emit sounds via the second sound hole 35 of the first side 34 after the heat is generated from the thermoelectric converter 20. In the second embodiment, the first sound hole 32 of the first side 31 and the second sound hole 35 of the second side 34 are connected to each other via the sound cavity 36; while in other embodiments, the first sound hole 32 can be disposed apart from the second sound hole 35 for eliminating interference of emitted sounds.

Accordingly, the present disclosure is capable of converting electrical audio signals to calorific capacity to heat the air in a sound cavity of a body so that the air is resonated to emit sound according to thermal acoustic effect. In addition, the present disclosure is further capable of adhering around any physical form. Thus, a compact and low power consumption speaker can be easily manufactured.

The disclosure is related to the detailed technical contents and inventive features thereof. A person having ordinary skill in the art may proceed with a variety of modifications and replacements based on the disclosures and suggestions of the invention as described without departing from the characteristics thereof. Nevertheless, although such modifications and replacements are not fully disclosed in the above descriptions, they have substantially been covered in the following claims as appended.

What is claimed is:

1. A thermal acoustic speaker, comprising:

a shell having a sound cavity formed therein, and comprising a top wall having a first sound hole exposed to an outside of shell and in communication with the sound cavity, and a peripheral wall extending down from the top wall and comprising at least one through hole in communication with the sound cavity; and a thermoelectric converter disposed around at least a part of the shell, comprising:

a circuit for receiving at least one electrical audio signal; and a conductive membrane contacting a part of the circuit, wherein the thermoelectric converter covers at least a part of the at least one through hole of the shell and heats air in the sound cavity to emit sound according to the at least one electrical audio signal.

2. The thermal acoustic speaker as claimed in claim 1, wherein the thermoelectric converter further comprises a flexible membrane with a surface, the conductive membrane is disposed on the surface of the flexible membrane, and the circuit is disposed between the flexible membrane and the conductive membrane.

3. The thermal acoustic speaker as claimed in claim 1, wherein the thermoelectric converter further comprises a flexible membrane with a surface, the conductive membrane is disposed on the surface of the flexible membrane, and the circuit is disposed on the conductive membrane.

4. The thermal acoustic speaker as claimed in claim 1, wherein the shell further comprises a bottom wall having a second sound hole exposed to an outside of the shell, and the second sound hole of the bottom wall is in communication with the sound cavity.

5. The thermal acoustic speaker as claimed in claim 4, wherein the first sound hole of the top wall and the second sound hole of the bottom wall are in communication with each other via the sound cavity.

6. The thermal acoustic speaker as claimed in claim 1, wherein the conductive membrane of the thermoelectric converter is an anisotropic conductive film (ACF).

7. The thermal acoustic speaker as claimed in claim 6, wherein the anisotropic conductive film comprises a plurality of carbon nanotubes (CNTs).

8. The thermal acoustic speaker as claimed in claim 7, wherein the circuit of the thermoelectric converter comprises a first conducting wire and a second conducting wire being substantially parallel with the first conducting wire.

9. The thermal acoustic speaker as claimed in claim 8, wherein the first conducting wire and the second conducting wire are electrically connected to each other via the anisotropic conductive film to heat the air in the sound cavity.

10. The thermal acoustic speaker as claimed in claim 1, wherein the shell is in a shape of a truncated cone, a cylinder, an elliptic cylinder, a triangular prism, a cuboid, a polygonal prism or an irregular prism.

11. The thermal acoustic speaker as claimed in claim 1, wherein the at least one through hole comprises a plurality of through holes, each of which is elongated and aligned along a respective path that is a shortest distance from the top wall to a bottom end of the shell.

* * * * *